US008563860B1

(12) United States Patent
Ramos, Jr.

(10) Patent No.: US 8,563,860 B1
(45) Date of Patent: Oct. 22, 2013

(54) LARGE LOOP RETRACTILE CORD

(76) Inventor: Phillip M. Ramos, Jr., Anaheim Hills, CA (US)

( * ) Notice: Subject to any disclaimer, the term of this patent is extended or adjusted under 35 U.S.C. 154(b) by 0 days.

(21) Appl. No.: 13/526,466

(22) Filed: Jun. 18, 2012

Related U.S. Application Data

(60) Provisional application No. 61/498,136, filed on Jun. 17, 2011.

(51) Int. Cl.
*H01B 7/06* (2006.01)

(52) U.S. Cl.
USPC ..... 174/69

(58) Field of Classification Search
USPC ..... 174/69, 103, 108, 131 A
See application file for complete search history.

(56) References Cited

U.S. PATENT DOCUMENTS

| | | | | | |
|---|---|---|---|---|---|
| 1,989,066 | A * | 1/1935 | Shaw | 174/69 |
| 2,039,475 | A * | 5/1936 | Campbell | 174/69 |
| 2,051,316 | A * | 8/1936 | Shaw | 174/69 |
| 2,206,703 | A * | 7/1940 | Lowe | 439/448 |
| 2,573,439 | A * | 10/1951 | Henning | 174/69 |
| 3,240,867 | A * | 3/1966 | Maddox | 174/69 |
| 3,274,329 | A * | 9/1966 | Timmons | 174/69 |
| 3,318,994 | A * | 5/1967 | Perrone et al. | 174/69 |
| 3,324,229 | A * | 6/1967 | Ingmanson | 174/69 |
| 3,694,279 | A * | 9/1972 | Rohrig et al. | 156/50 |
| 3,854,002 | A * | 12/1974 | Glander et al. | 174/69 |
| 3,993,860 | A * | 11/1976 | Snow et al. | 174/69 |
| 4,683,349 | A * | 7/1987 | Takebe | 174/69 |
| 4,852,964 | A * | 8/1989 | Holland et al. | 385/111 |
| 4,861,945 | A * | 8/1989 | Buck et al. | 174/69 |
| 4,945,191 | A * | 7/1990 | Satsuka et al. | 174/69 |
| 4,988,833 | A * | 1/1991 | Lai | 174/69 |
| 5,763,836 | A * | 6/1998 | Anastasi et al. | 174/92 |
| 2010/0006320 | A1 * | 1/2010 | Tatsumi | 174/113 R |

* cited by examiner

*Primary Examiner* — William H Mayo, III
(74) *Attorney, Agent, or Firm* — Roy L Anderson; Wagner, Anderson & Bright, P.C.

(57) ABSTRACT

An electrical power cable extension cord with a coiled section between the first and the second ends and at least one metal core conductor contained within the electrical power cable extension cord for transmitting electrical current to supply electrical power to a power device. The coiled section has a coiled diameter of approximately five times or more greater than the diameter of the electrical power cable extension cord.

19 Claims, 3 Drawing Sheets

LARGE LOOP RETRACTILE CORD

CROSS-REFERENCE TO RELATED APPLICATIONS

This application is a non-provisional of U.S. Patent Application Ser. No. 61/498,136, filed Jun. 17, 2011, of the same title, the disclosure of which is specifically incorporated herein by reference.

FIELD OF THE INVENTION

The present invention is in the field of extension cords.

BACKGROUND OF THE INVENTION

Extension cords usually have multiple wire conductors, each of which has its own insulator, which are then contained within an outer jacket covering. Cords with multiple conductors may also be bundled together with tape or a binder prior to jacketing.

Extension cords are sold coiled and uncoiled. Uncoiled extension cords are good for short distances, and can be stored in a retracting wheel device when they are longer. Coiled extension cords rely on their coiling to keep them neat when not extended, and they typically have a coiled diameter of one and one half to two times the cord diameter. In this regard, although it is not an extension cord, telephones commonly have coiled cords.

SUMMARY OF THE INVENTION

The present invention is generally directed to a coiled extension cord having a coiled diameter of at least 3.5 times, and preferably approximately 5.0 to 7.0 times, the cord diameter. The primary insulation and jacket of the extension cord has a hardness of approximately 50 D or more (and preferably 55 D or more) and is comprised of a blend of thermoplastic and/or thermoset materials of thermoplastic elastomers (which include polyester, polyurethane, olefin rubber) cross linked polyethylene, polypropylene, polyvinyl chlorine and ethylene vinyl acetate. The coiled portion of the extension cord has a memory that allows the cord to extend out up to approximately 25 to 30 time its retracted length, and then retract back to its retracted position. Memory is imparted to the coiled extension cord by first making the cord (or cable), then winding the cord around a mandrel or other device, backing the cord at a sufficient temperature and length of time to create the memory, and then reversing the winding of the cord.

Accordingly, it is a primary object of the present invention to provide an improved extension cord having a larger coiled diameter relative to the cord diameter with a hard jacket.

This and further objects and advantages will be apparent to those skilled in the art in connection with the drawings and the detailed description of the invention set forth below.

BRIEF DESCRIPTION OF THE DRAWINGS

FIG. 1 illustrates a side view of the extension cord in a coiled position while FIG. 4 illustrates a side view of the extension cord in an extended position. FIG. 2 illustrates a cross section of the extension cord while FIG. 3 illustrates a cross section of one coil of FIG. 1.

DETAILED DESCRIPTION OF THE INVENTION

The present invention is generally directed to a coiled extension cord having a hard outer jacket and a larger diameter coil relative to cord diameter than is conventional in the industry.

The present invention will now be discussed in connection with a preferred embodiment illustrated in FIGS. 1-4.

In the Figures and the following more detailed description, numerals indicate various features of the invention, with like numerals referring to like features throughout both the drawings and the description. Although the Figures are described in greater detail below, the following is a glossary of the elements identified in the Figures:

| | |
|---|---|
| 1 | retractile extension cord |
| 2 | cord |
| 3 | coils in cord 2 |
| 4 | outer diameter of coiled cord 2 |
| 5 | diameter of cord 2 |
| 6 | end connector 1 |
| 7 | end connector 2 |
| 21 | outer protective covering of cord |
| 22 | insulated conductors |
| 23 | copper wire in insulated conductors 22 |
| 24 | insulation of insulated conductors 22 |
| 25 | tape or binder wrapping the insulated conductors together |

Figure 1:
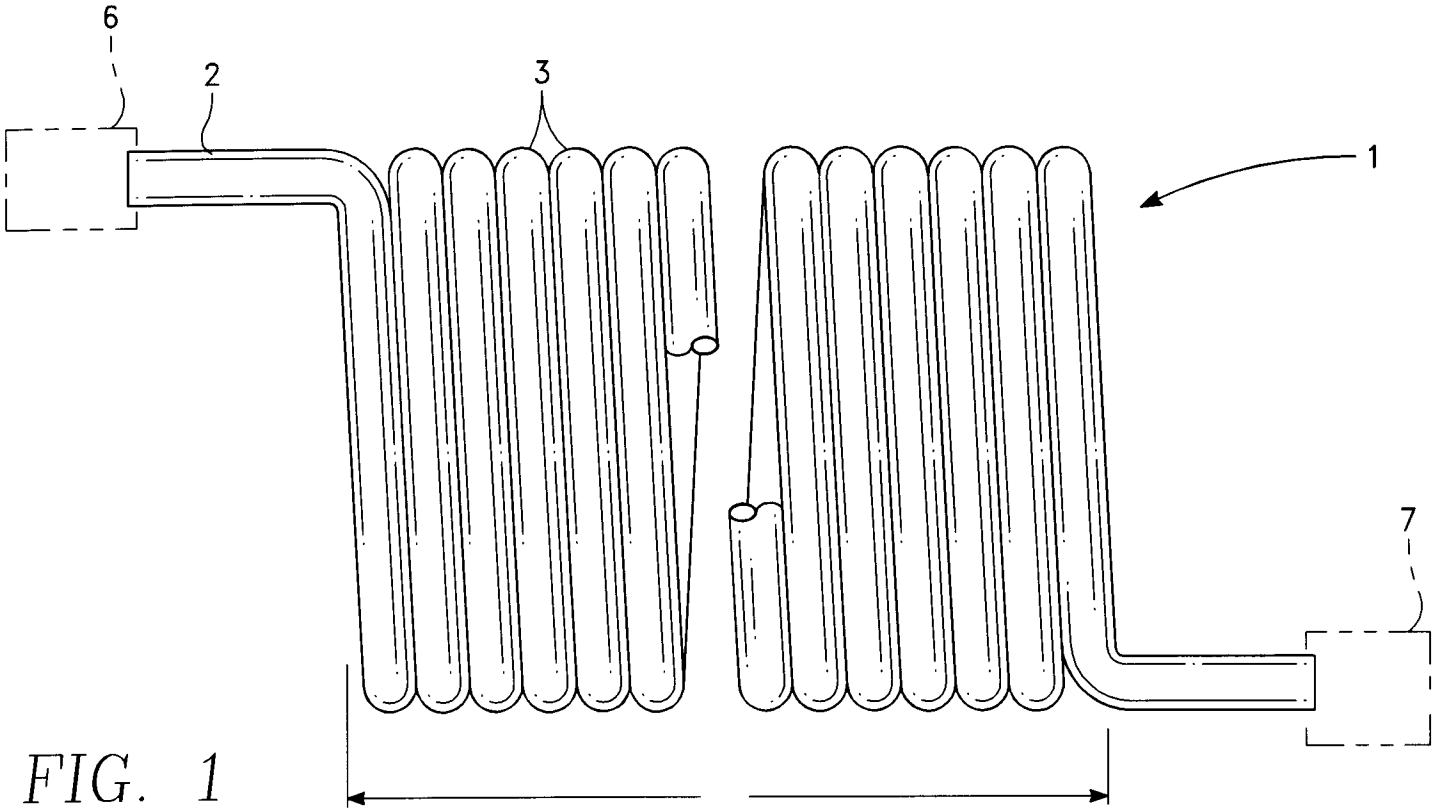
FIGS. 1-4 illustrate a coiled extension cord according to the present invention.

As illustrated in FIG. 1, the present invention is a coiled extension cord 1 having two ends, each of which may have a connector, two of which are shown generically as end connectors 6 and 7. End connectors 6 and 7 may be the same or different, and the exact nature and construction of any such connector is not important to the present invention. Suffice it to say, any suitable end connector, or lack thereof if that is desired in certain applications, may be used.

Figure 2:
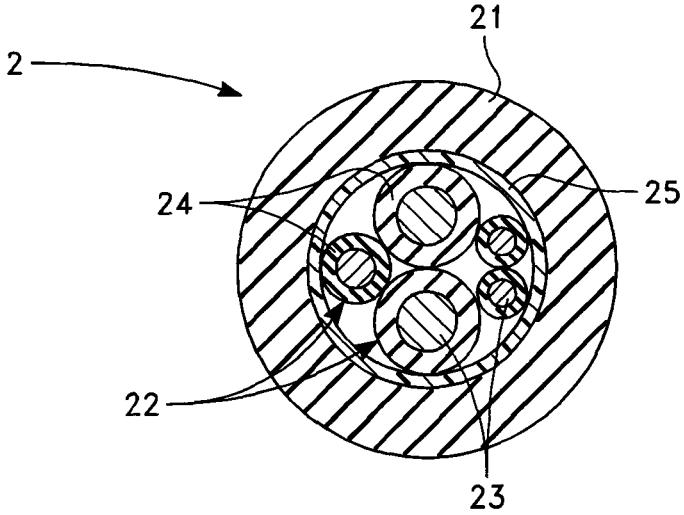
Figure 3:
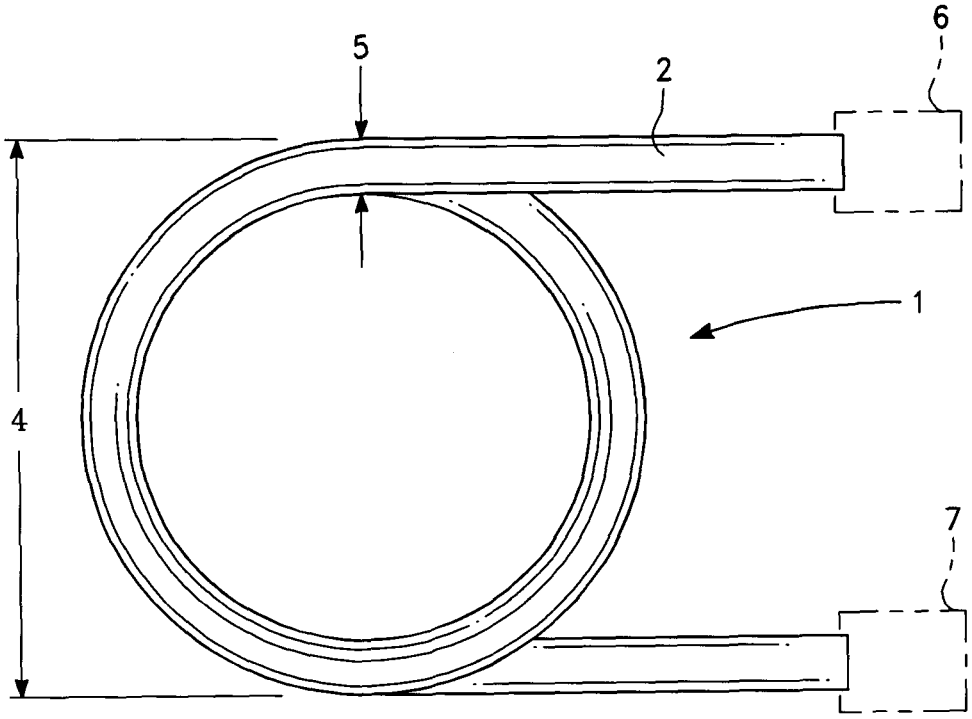
Figure 4:
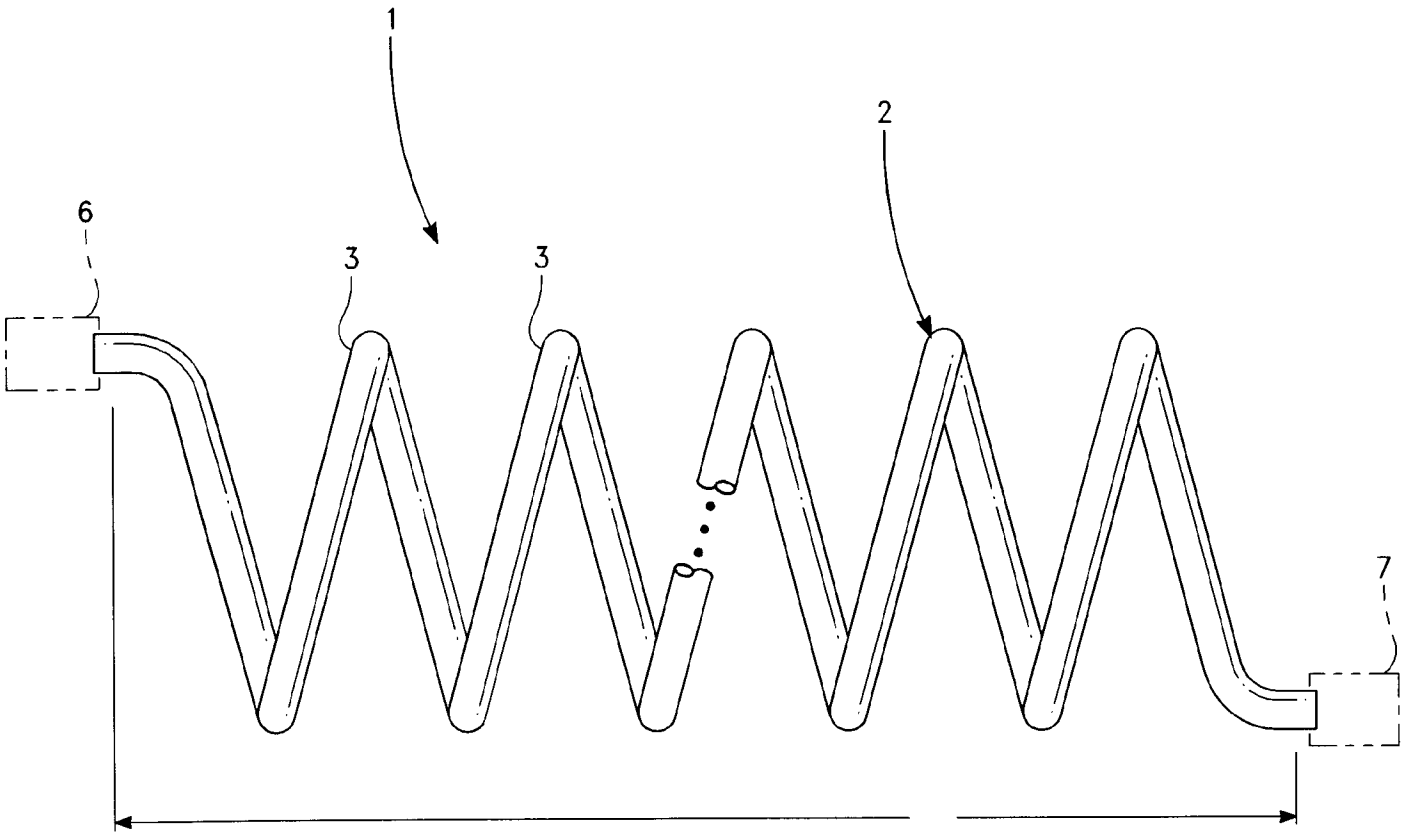

As is illustrated in FIG. 2, extension cord 1 has outer protective covering or jacket 21 that surrounds and insulates a core of one or more insulated conductors 22 to meet or exceed national or international electrical cord/cable standards and requirements. Each jacketed cord 2, which may have varying diameters, generally has multiple copper wires 23, each of which is surrounded by its own insulation 24. Multiple insulated conductors 22 may be wrapped in a binder or tape 25 inside of outer jacket 21. The number of wires in an extension cord 1 can vary from 1 to many, with 2 to 7 being common, depending upon expected use. The number of such wires, and their individual diameters, is not critical to the instant invention, except to the extent that such wires contribute to overall diameter 5 of cord 2.

Outer protective covering or jacket 21 of cord is important to the present invention. It is especially desirable that the thickness of jacket 21 be kept minimal so as to minimize overall diameter 5 of cord 2, although jacket 21 must still provide suitable insulating properties. To achieve this tradeoff, it is especially preferred that jacket 21 have a high Durometer hardness, e.g., a Durometer hardness of approximately 50 D or more, and more especially, approximately 55 D scale or more, which also increases its tensile strength compared to conventional extension cords that have a hardness of 75 to 87 A scale. To achieve such hardness, jacket 21 can be made of a blend of thermoplastic and/or thermoset materials of thermoplastic elastomers (which include polyester, polyurethane, olefin rubber) cross linked polyethylene, polypropylene, polyvinyl chlorine and ethylene vinyl acetate.

An extension cord according to the present invention should have a coiled diameter of at least 3.5 times, and preferably approximately 5.0 times or more, the cord diameter 2, as compared to a conventional coiled diameter of 1.5 to 2.0 times cord diameter.

A coiled extension cord according to the present invention has many advantages over a conventional coiled extension cord.

A coiled extension cord according to the present invention is anti-kinking and has cut resistance due to increased hardness, whereas conventional coiled extension cords can kink and are not cut resistant.

A coiled extension cord according to the present invention has high abrasion resistance and durability, as compared to moderate abrasion resistance and durability of conventional coiled extension cords.

A coiled extension cord according to the present invention has a coil extension force which has less pull force compared to conventional coiled cord which has the benefit of a lower possibility of pulling loose from a power source.

It is important for an extension cord according to the present invention to have a memory that will hold coils 3 in cord 2 tight when the extension cord is not in an extended condition (see FIG. 1). A coiled extension cord according to the present invention has a much higher ratio of extended length versus its shorter retracted length which has the benefit of requiring less storage space since it can extend out up to 25 to 30 times its retracted length whereas conventional coiled extension cords with longer retracted length can extend out up to 3 to 5 times their retracted length. Memory is created in the extension cord of the present invention by first making the cable, then winding it around a mandrel to create coils in the cable, then baking the material of the cable at a sufficient temperature for a sufficient time to create a memory characteristic in the jacket material, and then reversing the winding of the coils (thus, e.g., if the initial winding around a mandrel is clockwise, the winding upon reversal will be counterclockwise). (Anything that serves the same function as a mandrel can be used in place of a mandrel and, for purposes of the present invention, mandrel shall be defined a mandrel or anything else on which the coil windings can be made.)

Set forth below in Table 1 is a listing of a few exemplary extension cords according to the present invention. These examples are not meant in any way to be limiting, but merely illustrative examples of a few types of extension cords that can be made according to the present invention, and other types of extension cords, with different gauge sizes, cable diameters, coil diameters, and lengths, can be made according to the present invention.

TABLE 1

| UL Type | Gauge Size | Cable Diameter (Inch) | Mandrel Size (Inches) | Outer Diameter of Coiled Cord (Inches) | Retracted Length (Inches) | Working Length (Feet) | Free Length (Feet) |
|---|---|---|---|---|---|---|---|
| SVEO | 18/3 | .238 | 1.75 | 2.23 | 7 | 15 | 17.84 |
| SVEO | 16/3 | .268 | 2.20 | 2.74 | 10 | 25 | 27.52 |
| SVEO | 16/3 | .268 | 2.20 | 2.74 | 20 | 50 | 54.00 |
| EVJE | 14/3 | .325 | 2.70 | 3.35 | 10 | 25 | 27.80 |
| EVJE | 14/3 | .325 | 2.70 | 3.35 | 20 | 50 | 54.61 |
| EVJE | 12/3 | .372 | 3.00 | 3.75 | 10 | 25 | 27.10 |
| EVJE | 12/3 | .372 | 3.00 | 3.75 | 20 | 50 | 53.21 |
| SJEO | 10/3 | .533 | 3.00 | 4.07 | 14 | 25 | 27.72 |
| SJEO | 10/3 | .533 | 3.00 | 4.07 | 28 | 50 | 54.45 |

The practical space-saving extension cord of the present invention can be used with kitchen appliances, vacuum cleaners, hair dryers, cloth irons, recreational vehicles, marine docks, heavy contractor's electrical tools, garden electrical tools, handyman electrical tools, computers, electrical vehicles, and other applications with need of power supply and extension cords/cables.

While the invention has been described herein with reference to certain preferred embodiments, those embodiments have been presented by way of example only, and not to limit the scope of the invention. Additional embodiments thereof will be obvious to those skilled in the art having the benefit of this detailed description.

Accordingly, it will be apparent to those skilled in the art that still further changes and modifications in the actual concepts described herein can readily be made without departing from the spirit and scope of the disclosed inventions as defined by the following claims.

What is claimed is:

1. An apparatus, comprising:

an electrical power cable extension cord terminating in a first and a second end, said electrical power cable extension cord having a coiled section between the first and the second ends and at least one metal core conductor contained within the electrical power cable extension cord for transmitting electrical current to supply electrical power to a power device;

wherein the coiled section has a coiled diameter of approximately five times or more greater than a diameter of the electrical power cable extension cord.

2. The apparatus of claim 1 wherein the coiled diameter is approximately seven times or more greater than the diameter of the electrical power cable extension cord.

3. The apparatus of claim 2 wherein the electrical power cable extension cord has a primary insulation and jacket having a hardness of approximately 50 D or greater.

4. The apparatus of claim 2 wherein the electrical power cable extension cord has a primary insulation and jacket having a hardness of approximately 55 D or greater.

5. The apparatus of claim 1 wherein the coiled diameter is approximately ten times or more greater than the diameter of the electrical power cable extension cord.

6. The apparatus of claim 5 wherein the electrical power cable extension cord has a primary insulation and jacket having a hardness of approximately 50 D or greater.

7. The apparatus of claim 5 wherein the electrical power cable extension cord has a primary insulation and jacket having a hardness of approximately 55 D or greater.

8. The apparatus of claim 1 wherein the electrical power cable extension cord has a primary insulation and jacket having a hardness of approximately 50 D or greater.

9. The apparatus of claim 1 wherein the electrical power cable extension cord has a primary insulation and jacket having a hardness of approximately 55 D or greater.

10. The apparatus of claim 9 wherein the primary insulation and jacket is comprised of a blend of thermoplastic and/or thermoset materials of thermoplastic elastomers, cross-linked polyethylene, polypropylene, polyvinyl chlorine and ethylene vinyl acetate.

11. The apparatus of claim 1 wherein the electrical power cable extension cord can extend out up to approximately 25 to 30 times its retracted length.

12. The apparatus of claim 11 wherein the coiled section has a memory that returns the coiled section to a retracted state.

13. The apparatus of claim 1 wherein the coiled section has a memory that returns the coiled section to a retracted state.

14. The apparatus of claim 13 wherein the memory is imparted to the coiled section by creating a plurality of coil windings in a first direction from a cable, baking the plurality of coil windings at a sufficient temperature and for a sufficient time to create a memory characteristic, and then reversing the direction of the plurality of coil windings.

15. The apparatus of claim 14 wherein the plurality of coil windings are created by winding the cable about a mandrel.

16. An apparatus, comprising:

an electrical power cable extension cord terminating in a first and a second end, said electrical power cable extension cord having a coiled section between the first and the second ends and at least one metal core conductor contained within the electrical power cable extension cord for transmitting electrical current to supply electrical power to a power device;

wherein the coiled section has a coiled diameter of approximately five times or more greater than a diameter of the electrical power cable extension cord and has a memory that returns the coiled section to a retracted state;

wherein the electrical power cable extension cord has a primary insulation and jacket having a hardness of approximately 55 D or greater;

wherein the primary insulation and jacket is comprised of a blend of thermoplastic and/or thermoset materials of thermoplastic elastomers, cross-linked polyethylene, polypropylene, polyvinyl chlorine and ethylene vinyl acetate;

wherein the electrical power cable extension cord can extend out up to approximately 25 to 30 times its retracted length; and wherein the memory is imparted to the coiled section by creating a plurality of coil windings about a mandrel in a first direction from a cable, baking the plurality of coil windings at a sufficient temperature and for a sufficient time to create a memory characteristic, and then reversing the direction of the plurality of coil windings.

17. A method, comprising:

creating a plurality of coil windings in a first direction from an electrical power cable;

baking the plurality of coil windings at a sufficient temperature and for a sufficient time to create a memory characteristic; and reversing the direction of the plurality of coil windings to form an electrical power cable extension cord terminating in a first and a second end, said extension cord having a coiled section between the first and the second ends and at least one metal core conductor contained within the electrical power cable extension cord for transmitting electrical current to supply electrical power to a power device;

wherein the coiled section has a coiled diameter of approximately five times or more greater than a diameter of the extension cord; and wherein the cable has a primary insulation and jacket having a hardness of approximately 55 D or greater.

18. The method of claim 17 wherein the plurality of coil windings are created by winding the cable about a mandrel.

19. The method of claim 17 wherein the extension cord can extend out up to approximately 25 to 30 times its retracted length.

* * * * *